US008171730B2

(12) United States Patent
Oda et al.

(10) Patent No.: US 8,171,730 B2
(45) Date of Patent: May 8, 2012

(54) EXTERNAL COMBUSTION ENGINE

(75) Inventors: Shuzo Oda, Kariya (JP); Shinichi Yatsuzuka, Nagoya (JP); Yasunori Niiyama, Kuwana (JP); Takashi Kaneko, Nagoya (JP)

(73) Assignee: Denso Corporation, Kariya (JP)

( * ) Notice: Subject to any disclaimer, the term of this patent is extended or adjusted under 35 U.S.C. 154(b) by 693 days.

(21) Appl. No.: 12/380,753

(22) Filed: Mar. 3, 2009

(65) Prior Publication Data

US 2009/0223216 A1 Sep. 10, 2009

(30) Foreign Application Priority Data

Mar. 6, 2008 (JP) ..... 2008-055932

(51) Int. Cl.
*F02G 1/04* (2006.01)
*F01K 23/06* (2006.01)

(52) U.S. Cl. ..... 60/531; 60/508; 60/516; 60/670; 60/39.6

(58) Field of Classification Search ..... 60/508, 60/514, 517, 530, 531, 670–671, 39.6
See application file for complete search history.

(56) References Cited

U.S. PATENT DOCUMENTS

| | | | | |
|---|---|---|---|---|
| 4,489,553 | A * | 12/1984 | Wheatley et al. | 60/516 |
| 7,669,415 | B2 * | 3/2010 | Komaki et al. | 60/531 |
| 7,698,892 | B2 * | 4/2010 | Komaki et al. | 60/531 |
| 7,716,928 | B2 * | 5/2010 | Oda et al. | 60/531 |
| 2007/0220888 | A1 | 9/2007 | Komaki et al. | |

FOREIGN PATENT DOCUMENTS

| | | |
|---|---|---|
| JP | 58-057014 | 4/1983 |
| JP | 2007-255259 | 10/2007 |
| JP | 2008-190483 | 8/2008 |

* cited by examiner

*Primary Examiner* — Hoang M Nguyen
(74) *Attorney, Agent, or Firm* — Harness, Dickey & Pierce, PLC

(57) ABSTRACT

An external combustion engine provided with a pipe-shaped main container with a heating portion and a cooling portion, an output part converting displacement of the liquid part of said working fluid generated due to the change in volume of said working fluid accompanying generation and condensation of said steam to mechanical energy for output, a venturi provided at a communicating part of the main container and an auxiliary container, a communicating member forming a communicating passage bypassing the venturi and communicating the main container and the auxiliary container, and a shutting means for closing the communicating passage at the time of normal operation and opening the communicating passage at the time of startup, wherein at the time of startup, the pressure loss at the communicating passage becomes smaller than a saturated steam pressure at the temperature of the heating portion.

4 Claims, 4 Drawing Sheets

EXTERNAL COMBUSTION ENGINE

BACKGROUND OF THE INVENTION

1. Field of the Invention

The present invention relates to an external combustion engine generating and liquefying steam of a working fluid, using the accompanying change in volume of the working fluid to displace a liquid part of the working fluid, and converting this to mechanical energy for output.

2. Description of the Related Art

In the past, this type of external combustion engine has also been called a "liquid piston steam engine". A working fluid is sealed in a pipe-shaped main container flowably in a liquid state. Part of the liquid state working fluid is heated to evaporate at a heating portion formed at one end of the main container, while the steam of the working fluid is cooled to condense at a cooling portion formed at the intermediate part of the main container. By alternately repeatedly evaporating and condensing this working fluid, the liquid phase part of the working fluid is made to cyclically displace (so-called "self vibration") and the self vibration of the liquid phase part of this working fluid is taken out at the output part as mechanical energy (for example, see Japanese Patent Publication (Kokai) No. 2007-255259).

This art aims at controlling the average value of the internal pressure of the main container so as to approach the target value. Therefore, it can improve the output and efficiency of the external combustion engine. More specifically, by sealing the working fluid in an auxiliary container separate from the main container in the liquid state and connecting the main container and the auxiliary container through a venturi, the internal pressure of the auxiliary container is stabilized at a pressure substantially equal to the average value of the internal pressure of the main container.

Further, the target value of the average value of the internal pressure of the main container is calculated based on the temperature of the heater etc. and the working fluid in the auxiliary container is compressed or expanded by the piston mechanism so as to control the internal pressure of the auxiliary container to approach the target value. By doing this, the average value of the internal pressure of the main container is made to change to track the internal pressure of the auxiliary container and approach the target value.

SUMMARY OF THE INVENTION

In this art, if the external combustion engine is stopped and the heating of the working fluid by the heater is stopped, the temperature of the heater gradually falls to the ambient temperature. When the external-combustion engine stops, if steam of the working fluid has built up in the main container, the saturated steam pressure of the working fluid also falls along with the drop in temperature of the heater and the steam of the working fluid condenses and liquefies. For this reason, the internal pressure of the main container falls.

When the internal pressure of the main container falls more than the internal pressure of the auxiliary container, the working fluid in the auxiliary container passes through the venturi and gradually flows into the main container whereby the amount of working fluid in the main container becomes excessive. This phenomenon particularly occurs in the winter when the ambient temperature is low.

In this way, in the state where the amount of the working fluid in the main container becomes excessive, if the external combustion engine is restarted and the heater is used to heat the working fluid: part of the working fluid will vaporize and the internal pressure of the main container will rise. If the internal pressure of the main container rises more than the internal pressure of the auxiliary container, the excess part of the working fluid in the main container passes through the venturi and is returned to the auxiliary container. When the excess part of the working fluid in the main container all returns to the auxiliary container and the amount of the working fluid in the main container becomes a suitable amount, a predetermined output is generated.

However, with a venturi, the working fluid can only flow a very little at a time, so time ends up being taken for the excess part of the working fluid in the main container to all return to the auxiliary container. For this reason, there is the problem that the startup time from restart to the time when a predetermined output is obtained, ends up becoming longer.

To avoid this problem at the time of restart, it is necessary to make the external combustion engine stop at a timing where steam of the working fluid has not built up in the main container. The operation for stopping the external combustion engine ends up being extremely troublesome.

Therefore, the assignee previously filed Japanese Patent Application No. 2007-27848 (below, called the "related art") in Japan claiming an external combustion engine able to quickly generate a predetermined output after start of startup. In this related art, not only are the main container and the auxiliary container communicated through a venturi, but also the main container and the auxiliary container are communicated by a communicating passage bypassing the venturi. Furthermore, a valve for shutting the communicating passage is provided. At the time of normal operation, the valve is closed, while at the time of startup, the valve is opened.

Due to this, at the time of normal operation, the main container and the auxiliary container are communicated only through the venturi, while at the time of startup, the main container and the auxiliary container are communicated not only through the venturi, but also through the communicating passage. Further, at the time of startup, the generator forming the output part is supplied with electric power from the outside to drive the generator so that the piston passes bottom dead center at least one time.

In this case, at the time of startup, the piston moves from top dead center toward bottom dead center, whereby the working fluid in the main container is compressed, so the excess part of the working fluid in the main container passes through the communicating passage and is quickly returned to the auxiliary container. For this reason, it is possible to shorten the startup time from restart to the time when a predetermined output is obtained.

However, according to detailed studies of the inventors, it is learned that in this related art, there is the problem that if the liquid part of the working fluid flows into the heating portion at the time of startup, heat loss ends up occurring. That is, at the time of startup when output cannot be taken out, if the liquid part of the working fluid flows into the heating portion and heat exchange is performed between the heating portion and the liquid part of the working fluid, that amount of heat cannot be taken out as output and ends up becoming heat loss.

The inventors studied preventing air from flowing from the output part side into the main container by sealing a working fluid inside the output part. In this study as well, after the external combustion engine was stopped, the working fluid in the output part gradually flowed into the main container and the amount of working fluid in the main container became excessive. In this study as well, a similar problem occurred in this related art. That is, it is desirable that after the start of startup, the excess part of the working fluid in the main container quickly be returned to the output part and the predetermined output be quickly produced.

The present invention, in consideration of this problem, has as its object keeping the liquid part of the working fluid from flowing into the heating portion at the time of startup.

To achieve the object, in the aspect of the invention as set forth in claim 1, there is provided an external combustion engine provided with:

a pipe-shaped main container in which a working fluid is sealed flowable in a liquid state, a heating portion formed at a location at one end of the main container and heating the part of the working fluid in the main container to generate steam of the working fluid, a cooling portion formed at a location of said main container on the other end side thereof from the heating portion and cooling the steam to condense, an output part communicating with the other end of the main container and converting displacement of the liquid part of the working fluid generated due to the change in volume of the working fluid accompanying generation and condensation of the steam to mechanical energy for output, an auxiliary container communicating with the main container and having the working fluid sealed inside it, a venturi provided at a communicating part between the main container and the auxiliary container, a communicating member forming a communicating passage bypassing the venturi and communicating the main container and the auxiliary container, and a shutting means closing the communicating passage at the time of normal operation and opening the communicating passage at the time of startup, the output part having a piston displacing upon receiving pressure from the liquid part of the working fluid and a cylinder slidably holding the piston, the output part being driven as a startup means at the time of the startup, a displacement speed of the piston becoming the displacement speed of the piston at the time of normal operation or more when the output part is driven as the startup means, the communicating passage being formed so that when the output part is driven as the startup means and the displacement speed of the piston becomes the displacement speed of the piston at the time of normal operation or more, the pressure loss at the communicating passage becomes smaller than a saturated steam pressure at the temperature of the heating portion.

According to this, at the time of startup, the pressure loss at the communicating passage becomes smaller than the saturated steam pressure at the temperature of the heating portion, so the excess part of the working fluid in the main container can more easily flow to the communicating passage side than the heating portion side and as a result the liquid part of the working fluid can be kept from flowing into the heating portion.

In the aspect of the invention as set forth in claim 2, there is provided the external combustion engine as set forth in claim 1 wherein the output part has a casing communicating with the main container through the cylinder and having the working fluid sealed in it, the auxiliary container is formed by the casing, the venturi is formed by a very small clearance between the piston and the cylinder, and the communicating passage bypasses the cylinder and communicates the casing and the main container.

According to this, the flow length of the communicating passage can easily be made shorter, so the pressure loss at the communicating passage can easily be made smaller than the saturated steam pressure at the temperature of the heating portion.

In the aspect of the invention as set forth in claim 3, there is provided an external combustion engine provided with a pipe-shaped main container in which a working fluid is sealed flowable in a liquid state, a heating portion formed at a location at one end of the main container and heating the part of the working fluid in the main container to generate steam of the working fluid, a cooling portion formed at a location of said main container on the other end side thereof from the heating portion and cooling the steam to condense, an output part communicating with the other end of the main container and converting displacement of the liquid part of the working fluid generated due to the change in volume of the working fluid accompanying generation and condensation of the steam to mechanical energy for output, an auxiliary container communicating with the main container and having the working fluid sealed inside it, a venturi provided at a communicating part between the main container and the auxiliary container, a communicating passage bypassing the venturi and communicating the main container and the auxiliary container, and a shutting means closing the communicating passage at the time of normal operation and opening the communicating passage at the time of startup, the output part having a piston displacing upon receiving pressure from the liquid part of the working fluid and a cylinder slidably holding the piston, the output part being driven as a startup means at the time of the startup, when the output part is driven as the startup means, a displacement speed of the piston becoming slower than a displacement speed of the piston at the time of normal operation.

According to this, at the time of startup, it is possible to lower the flow rate of the working fluid flowing through the communicating passage and possible to reduce the pressure loss at the communicating passage compared with the time of normal operation. For this reason, at the time of startup, it is possible to make the excess part of the working fluid in the main container easily flow to the communicating passage side and as a result suppress the flow of the liquid part of the working fluid to the heating portion.

In the aspect of the invention as set forth in claim 4, there is provided the external combustion engine as set forth in claim 3 wherein when the output part is driven as the startup means, the displacement speed of the piston is a speed whereby the pressure loss at the communicating passage becomes smaller than the saturated steam pressure at the temperature of the heating portion.

Due to this, at the time of startup, the excess part of the working fluid in the main container more easily flows to the communicating passage side rather than the heating portion side, so it is possible to suppress the liquid part of the working fluid flowing into the heating portion.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

First Embodiment

Figure 1:
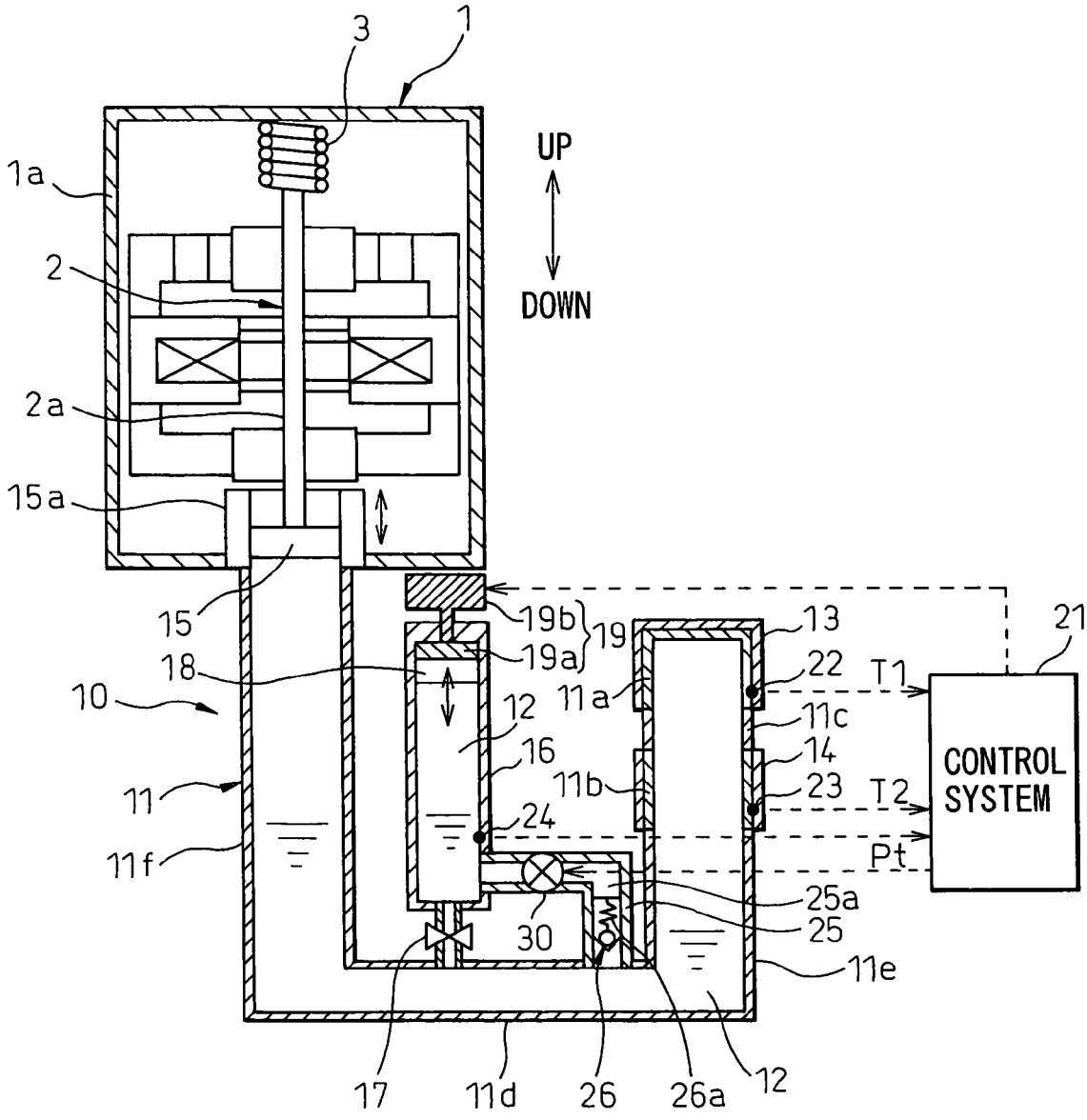
FIG. 1 is a view showing an outline of an external combustion engine in a first embodiment of the present invention.

Below, a first embodiment of the present invention will be explained. The present embodiment applies the external combustion engine according to the present invention to a power generating system. FIG. 1 is a view showing an outline of the power generating system according to this embodiment. The basic configuration of this power generating system is similar to that of the engine disclosed in Japanese Patent Publication (Kokai) No. 2007-255259, so first the part of the configuration common with this will be explained.

An external combustion engine 10 makes a movable body 2 in which a permanent magnet is buried displace by vibration to drive a generator 1 generating an electromotive force. This is provided with a main container 11 in which a working fluid 12 is sealed flowable in a liquid state, a heater 13 heating the working fluid 12 in the main container 11 to vaporize it, and a cooler 14 cooling the steam of the working fluid 12 vaporized by heating by the heater 13. In the present embodiment, water is used as the working fluid 12, but a refrigerant etc. may also be used.

In the present embodiment, the heater 13 is designed to exchange heat with a high temperature gas (for example, automobile exhaust gas). The heater 13 may also be configured by an electric heater. Further, in the present embodiment, the cooler 14 has cooling water circulating in it. While not illustrated, in the circulating circuit of the cooling water is arranged a radiator radiating the heat which the cooling water robs from the steam of the working fluid 12.

In the main container 11, a portion contacting the heater 13, that is, a heating portion 11*a*, and a portion contacting the cooler 14, that is, a cooling portion 11*b*, are preferably made of materials superior in heat conductivity. In the present embodiment, the heating portion 11*a* and cooling portion 11*b* are made of copper or aluminum. The heating portion 11*a* may have the heater 13 formed integrally with it, while the cooling portion 11*b* may have the cooler 14 formed integrally with it.

On the other hand, in the main container 11, an intermediate part 11*c* between the heating portion 11*a* and the cooling portion 11*b* is preferably made of a material superior in heat insulation. In the present embodiment, the working fluid 12 is made water, so this is made stainless steel. The part of the main container 11 at the generator 1 side from the cooling portion 11*b* is also made of stainless steel superior in heat insulation.

The main container 11 is a pipe-shaped pressure container formed into a generally U-shape with a bent part 11*d* positioned at its bottommost part and first and second straight parts 11*e* and 11*f* extending in the vertical direction. At the first straight part 11*e* of the main container 11 at one end across the bent part 11*d* (right side of FIG. 1) are arranged the heater 13 and cooler 14. The heater 13 is positioned at a higher side than the cooler 14.

While not shown, to secure space for vaporization of the working fluid 12, at the top end part of the first straight part 11*e*, a predetermined volume of gas (for example, air) is sealed.

On the other hand, at the top end of the second straight part 11*f* at the other side of the main container 11 across the bent part 11*d* (left side of FIG. 1), the generator 1 is arranged. Inside the casing 1*a* of the generator 1, an output takeout piston 15 displacing by receiving pressure from the liquid part of the working fluid 12 is arranged slidably in a cylinder 15*a*. The generator 1 corresponds to the output part in the present invention.

The piston 15 is coupled with a shaft 2*a* of the movable body 2 in the casing 1*a* of the generator 1. At the opposite side of the piston 15 across the movable body 2, a spring 3 forming an elastic means for generating an elastic force pushing the movable body 2 to the piston 15 side is provided.

As the details will be explained later, the generator 1 can be driven by electric power supplied from the outside. At the time of startup of the external combustion engine 10, the generator 1 functions as a startup means (starter motor) for making the piston 15 displace to make the external combustion engine 10 start up. When generator 1 is driven as a startup means, the displacement speed of the piston 15 is set at the displacement speed of the piston 15 at the time of normal operation or more.

In the main container 11, above the bent part 11*d*, an auxiliary container 16 is arranged for adjusting the internal pressure of the main container 11 (below, referred to as the "main container pressure"). The bent part 11*d* and a bottom of the auxiliary container 16 are communicated through a venturi 17. The inner volume of this auxiliary container 16 is designed to be smaller than the inner volume of the main container 11.

The venturi 17 acts to stabilize the internal pressure Pt of the auxiliary container 16 (below, referred to as the "auxiliary, container pressure") at a pressure substantially equal to an average value of the main container pressure (below, referred to as the "main container average pressure"). In the present embodiment, as the venturi 17, a fixed venturi with a reduced flow diameter is used.

The bottom part in the auxiliary container 16 is filled with the working fluid 12 in a liquid state. The top part in the auxiliary container 16 is filled with a gas 18. As the gas 18, a gas insoluble in the working fluid 12 is preferably used. In the present embodiment, as the gas 18, helium, which is insoluble in water, is used. The auxiliary container 16 may also be filled inside it with only the liquid state working fluid 12.

The auxiliary container 16 and venturi 17 are preferably made of materials superior in heat insulation. In the present embodiment, the auxiliary container 16 and venturi 17 are made of stainless steel.

A piston mechanism 19 serving as a pressure adjustment mechanism for adjusting the auxiliary container pressure Pt is comprised of a pressure adjustment piston 19*a* and an electric actuator 19*b*. The pressure adjustment piston 19*a* is arranged at the top end in the auxiliary container 16 and is designed to be driven back and forth in the vertical direction by the external electric actuator 19*b* of the auxiliary container 16.

Next, an outline of an electronic control unit in the present embodiment will be explained. A control system 21 is comprised by a known microcomputer having a CPU, ROM, RAM, etc. and its peripheral circuits.

The control system 21 receives as input detection signals for control of the piston mechanism 19 from a heating portion temperature sensor 22 for detecting a temperature T1 of the heating portion 11*a* (below, called the "heating portion temperature"), a cooling portion temperature sensor 23 for detecting a temperature T2 of the cooling portion 11*b* (below, referred to as the "cooling portion temperature"), and a pressure sensor 24 for detecting an auxiliary container pressure Pt. The control system 21 is designed to control the drive of the electric actuator 19*b* based on the detection signals from the sensors 22 to 24.

In the present embodiment, to obtain a predetermined output quickly after the beginning of startup, the following point is changed from the engine disclosed in Japanese Patent Publication (Kokai) No. 2007-255259. That is, in the present embodiment, a communicating part adjusting means for adjusting the flow area etc. of the communicating part between the main container 11 and the auxiliary container 16 is provided.

This communicating part adjusting means is comprised of a communicating member 25 forming a communicating passage 25*a* bypassing the venturi 17 and communicating the main container 11 and the auxiliary container 16, a check valve 26 arranged in the communicating passage 25*a*, and a valve 30 comprising a shutting means shutting the communicating passage 25*a*.

More specifically, the communicating passage 25*a* communicates the bent part 11*d* of the main container 11 and the bottom part of the auxiliary container 16 where the working fluid 12 is present. The flow area of the communicating passage 25*a* is larger than the flow area of the venturi 17.

The flow area and flow length of the communicating passage 25*a* are set so that the flow loss (pressure loss) of the communicating passage 25*a* becomes smaller than the saturated steam pressure at the heating portion temperature T1 when the generator 1 is driven as a startup means and the displacement speed of the piston 15 is the displacement speed of the piston 15 at the time of normal operation or more. In the present embodiment, the communicating passage 25*a* is made of stainless steel.

The check valve 26 allows the flow of the working fluid 12 in the communicating passage 25*a* from the main container 11 to the auxiliary container 16 and prevents the backflow of the working fluid 12 from the auxiliary container 16 to the main container 11. In the present embodiment, as the check valve 26, a spring type check valve having a spring part 26*a* is used. This is designed to open when the main container pressure is larger than the auxiliary container pressure Pt.

The valve 30 is controlled to open and close by the control system 21 so that it closes at the time of normal operation and opens only at the time of startup of the external combustion engine 10.

Next, the operation in the above configuration will be explained.

The basic operation is similar to that of the engine disclosed in Japanese Patent Publication (Kokai) No. 2007-255259, so only an outline will be simply explained.

If operating the heater 13 and the cooler 14, the working fluid (water) 12 in the heating portion 11*a* is heated to vaporize by the heater 13. When the high temperature, high pressure steam of the working fluid 12 builds up in the heating portion 11*a*, and the level of the working fluid 12 in the first straight part 11*e* of the main container 11 is pushed down.

This being the case, in the main container 11, the liquid part of the working fluid 12 displaces from the first straight part 11*e* side to the second straight part 11*f* side and pushes up the piston 15 at the generator 1 side. At this time, the piston 15 pushes against the spring 3 to make it elastically deform.

Further, when the level of the working fluid 12 in the first straight part 11*e* falls down to the cooling portion 11*b* and the steam of the working fluid 12 enters in the cooling portion 11*b*, this steam is cooled by the cooler 14 to become liquefied, so the force pushing down the level of the working fluid 12 in the first straight part 11*e* is canceled out.

As a result, the piston 15 at the generator 1 side pushed up once by the expansion of the steam of the working fluid 12 descends due to the elastic recovery force of the spring 3, the liquid part of the working fluid 12 displaces from the second straight part 11*f* side to the first straight part 11*e* side in the main container 11, and the level at the first straight part 11*e* side rises.

This operation is repeated until the operations of the heater 13 and cooler 14 are stopped. The liquid part of the working fluid 12 in the main container 11 displaces cyclically (so-called self vibration) and makes the movable body 2 of the generator 1 move up and down.

The control system 21 performs control to adjust the main container pressure. An outline of this control will be explained below. The control system 21 uses the heating portion temperature T1 and the steam pressure curve of the working fluid 12 stored in advance in the control system 21 to calculate the saturated steam pressure of the working fluid 12 at the heating portion temperature T1. Further, it uses the cooling portion temperature T2 and the steam pressure curve of the working fluid 12 to calculate the saturated steam pressure of the working fluid 12 at the cooling portion temperature T2.

Next, the target value of the main container average pressure will be calculated. In the present embodiment, the average value of the saturated steam pressure of the working fluid 12 at the heating portion temperature T1 and the saturated steam pressure of the working fluid 12 at the cooling portion temperature T2 is calculated and this average value is made the target value of the main container average pressure.

The saturated steam pressure of the working fluid 12 at the cooling portion temperature T2 becomes substantially equal to the atmospheric pressure (0.1 MPa), so the average value of the saturated steam pressure of the working fluid 12 at the heating portion temperature T1 and the atmospheric pressure (0.1 MPa) may also be made the target value. The value suitably corrected on the basis of these average values, may also be made the target value.

When the auxiliary container pressure Pt is lower than the target value, the electric actuator 19*b* pushes out the pressure adjustment piston 19*a* and reduces the volume of the auxiliary container 16. Due to this, the working fluid 12 in the auxiliary container 16 is compressed and the auxiliary container pressure Pt rises.

On the other hand, when the auxiliary container pressure Pt is higher than the target value, it pulls in the pressure adjustment piston 19*a* and reduces the volume of the auxiliary container 16. Due to this, the working fluid 12 in the auxiliary container 16 expands and auxiliary container pressure Pt falls.

In this way, the main container average pressure changes tracking the auxiliary container pressure and approaches the target value. Therefore, even if the heating portion temperature T1 fluctuates, the main container average pressure can be maintained at substantially the target value, so a drop in the performance due to fluctuations in the heating portion temperature T1 (output and efficiency) can be prevented.

Next, the characterizing operation of this configuration will be explained.

In the above configuration, if the external combustion engine 10 stops when the piston 15 is positioned at other than bottom dead center, the steam of the working fluid 12 is present in the first straight part 11*e* of the main container 11. In that state, the heating of the working fluid 12 by the heater 13 stops. As a result, the heating portion temperature T1 gradually falls down to the ambient temperature. Further, as the heating portion temperature T1 falls and the saturated steam pressure declines, the steam of the working fluid 12 is condensed and liquefies and the main container pressure falls.

If the main container pressure ends up falling below the auxiliary container pressure Pt, the working fluid 12 in the auxiliary container 16 passes through the venturi 17 and flows into the main container 11 whereupon the amount of the working fluid 12 in the main container 11 (below, called "the amount of liquid in the main container") becomes excessive. This phenomenon easily occurs particularly in the winter when the ambient temperature is low.

In this way, when the amount of liquid in the main container becomes excessive, a predetermined output cannot be obtained. However, in the present embodiment, as explained below, at the time of restart of the external combustion engine 10, the excess part of the amount of liquid in the main container (surplus liquid for operation) can be quickly drained to the auxiliary container 16, so it is possible to obtain the predetermined output quickly after the start of restart.

Figure 2:
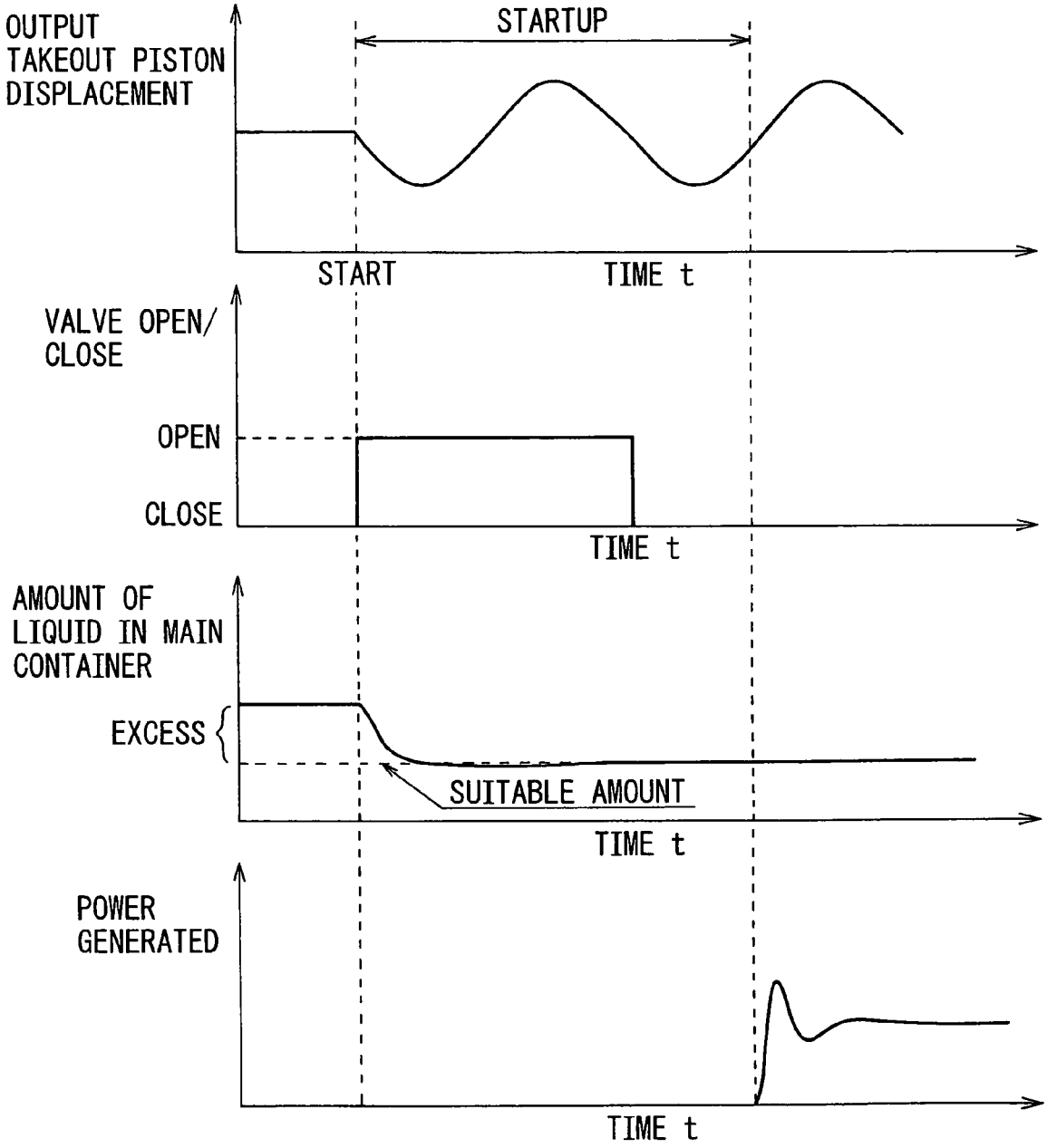
FIG. 2 is a timing chart showing the operation at the time of startup in the first embodiment.

FIG. 2 is a timing chart showing the operation at the time of startup of the external combustion engine 10. At the time of startup of the external combustion engine 10, the generator 1 is driven as the startup means. Specifically, the generator 1 is driven by electric power supplied from the outside and makes the output takeout piston 15 displace by at least one cycle.

At this time, the displacement speed of the piston 15 becomes the same as or larger than the displacement speed of the piston 15 at the time of normal operation. In the case of FIG. 2, the displacement speed of the piston 15 at this time becomes the same as the displacement speed of the piston 15 at the time of normal operation.

While the generator 1 is driven as a startup means and the piston 15 is made to displace by 1 cycle or more, the piston 15 passes bottom dead center at least one time. When the piston 15 moves from top dead center toward bottom dead center, the working fluid 12 in the main container 11 is compressed and the main container pressure rises to the maximum operating pressure Pcmax or more.

In the present embodiment, when the external combustion engine 10 is stopped, the pressure adjustment piston 19*a* is operated to the top end most position of FIG. 1 and the auxiliary container pressure Pt becomes the smallest pressure. For this reason, the main container pressure becomes larger than the auxiliary container pressure Pt.

When not providing the communicating passage 25*a*, if the main container pressure becomes larger than the auxiliary container pressure Pt, the working fluid 12 in the main container 11 passes through only the venturi 17 and flows a very little at a time to the auxiliary container 16. For this reason, it ends up taking time for the excess part of the amount of liquid in the main container to drain to the auxiliary container 16.

In the present embodiment, if the main container pressure becomes larger than the auxiliary container pressure Pt, the check valve 26 arranged at the communicating passage 25*a* opens and the working fluid 12 in the main container 11 passes through the check valve 26 and flows to the auxiliary container 16 side. At the time of startup of the external combustion engine 10, the valve 30 is opened for exactly a predetermined time, so the working fluid 12 in the main container 11 passes through the communicating passage 25*a* and flows into the auxiliary container 16.

In short, in the present embodiment, at the time of normal operation, the main container 11 and the auxiliary container 16 are communicated through only the small communicating area venturi 17, while at the time of startup, the main container 11 and the auxiliary container 16 are communicated not only through the venturi 17, but also through the communicating passage 25*a* with a larger communicating area than the venturi 17. For this reason, the excess part of the amount of liquid in the main container can be quickly drained to the auxiliary container 16, so it is possible to shorten the startup time from restart to when a predetermined output is obtained.

Furthermore, in the present embodiment, the communicating passage 25*a* is formed so that when the generator 1 is driven as a startup means and the displacement speed of the piston 15 becomes the displacement speed of the piston 15 at the time of normal operation or more, the pressure loss at the communicating passage 25*a* becomes smaller than the saturated steam pressure at the heating portion temperature T1. Therefore, at the time of startup, the excess part of the amount of liquid in the main container more easily flows to the communicating passage 25*a* side than the heating portion 11*a* side and as a result it is possible to suppress the inflow of the liquid part of the working fluid 12 to the heating portion 11*a*.

As a result, at the time of startup when output cannot be taken out, it is possible to suppress heat exchange between the heating portion and the liquid part of the working fluid, so it is possible to reduce the heat loss at the time of startup.

In the case of FIG. 2, while the valve 30 is opened, the working fluid 12 in the main container 11 ends up flowing out somewhat to the auxiliary container 16. Even if the amount of liquid in the main container sometimes ends up being somewhat insufficient, after that the working fluid 12 in the auxiliary container 16 will pass through the venturi 17 and gradually flow into the main container 11 whereby the amount of liquid in the main container will be secured in a suitable level.

The valve 30 is closed at the time of normal operation, so even if the check valve 26 is opened at the time of normal operation of the external combustion engine 10, the valve 30 prevents the working fluid 12 from passing through the communicating passage 25*a* and flowing into the auxiliary container 16. Therefore, at the time of normal operation, the working fluid 12 will not pass through the communicating passage 25*a* and flow into the auxiliary container 16, so that a reduction in the amount of liquid in the main container may not be caused. As a result, the drop in performance of the external combustion engine 10 is prevented.

Second Embodiment

In the first embodiment, the flow area and flow length of the communicating passage 25*a* are used to set the pressure loss of the communicating passage 25*a*. In the second embodiment, the displacement speed of the piston 15 at the time of startup of the external combustion engine 10 is set to reduce the pressure loss of the communicating passage 25*a*.

Figure 3:
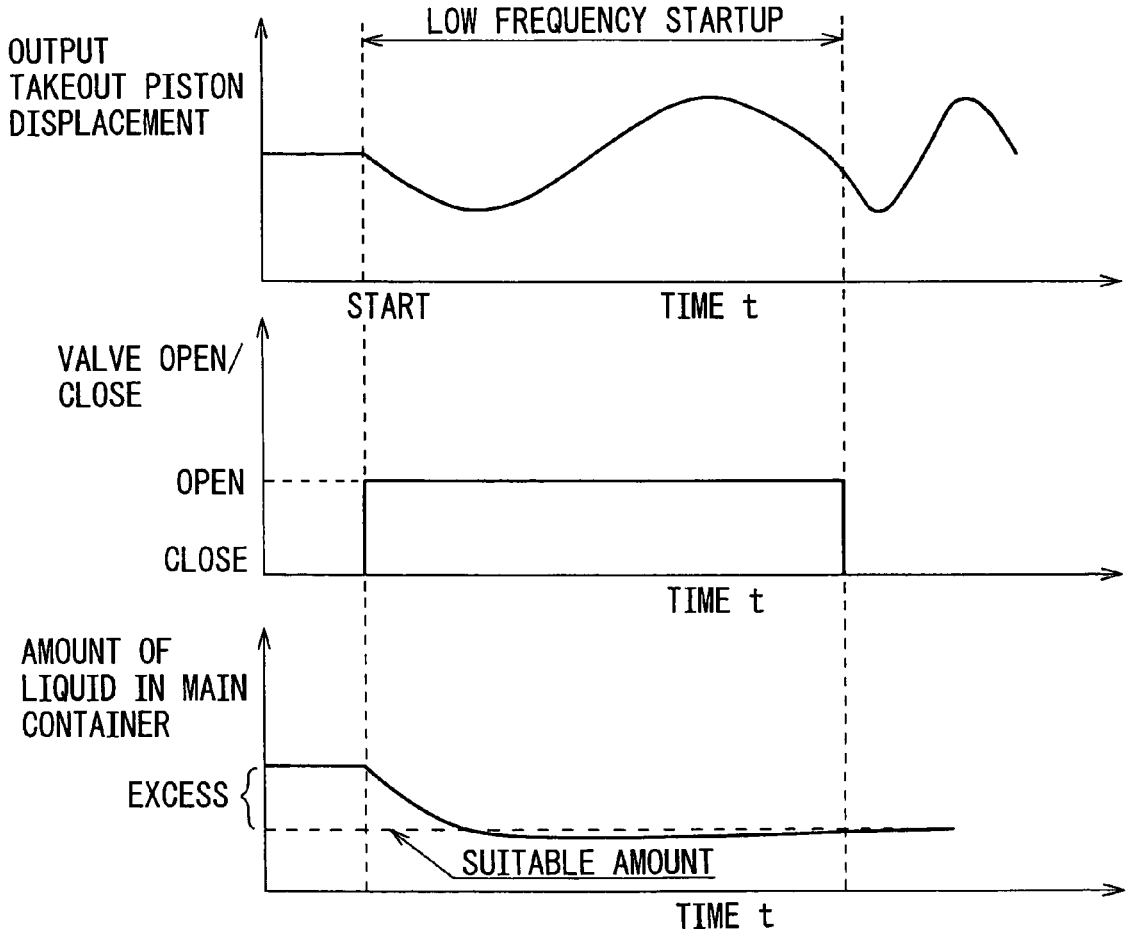
FIG. 3 is a timing chart showing the operation at the time of startup in a second embodiment.

FIG. 3 is a timing chart showing the operation at the time of startup in the present embodiment. In the present embodiment as well, in the same way as the first embodiment, at the time of startup of the external combustion engine 10, power is supplied to the generator 1 from the outside to drive the generator 1 and make the piston 15 displace by one cycle or more. In the present embodiment, at this time, the generator 1 is driven by a low frequency. Specifically, for example, the external load of the generator 1 is made larger to reduce the drive frequency of the generator 1.

Due to this, the displacement speed of the piston 15 at the time of startup of the external combustion engine 10 becomes smaller and the flow rate of the working fluid 12 flowing through the communicating passage 25*a* falls, so the pressure loss of the communicating passage 25*a* can be reduced.

In the present embodiment, the displacement speed of the piston 15 at the time of startup of the external combustion engine 10 is made slower than at the time of normal operation so as to make the pressure loss of the communicating passage 25*a* smaller than the saturated steam pressure at the heating portion temperature T1. For this reason, it is possible to obtain effects similar to the first embodiment.

Third Embodiment

Figure 4:
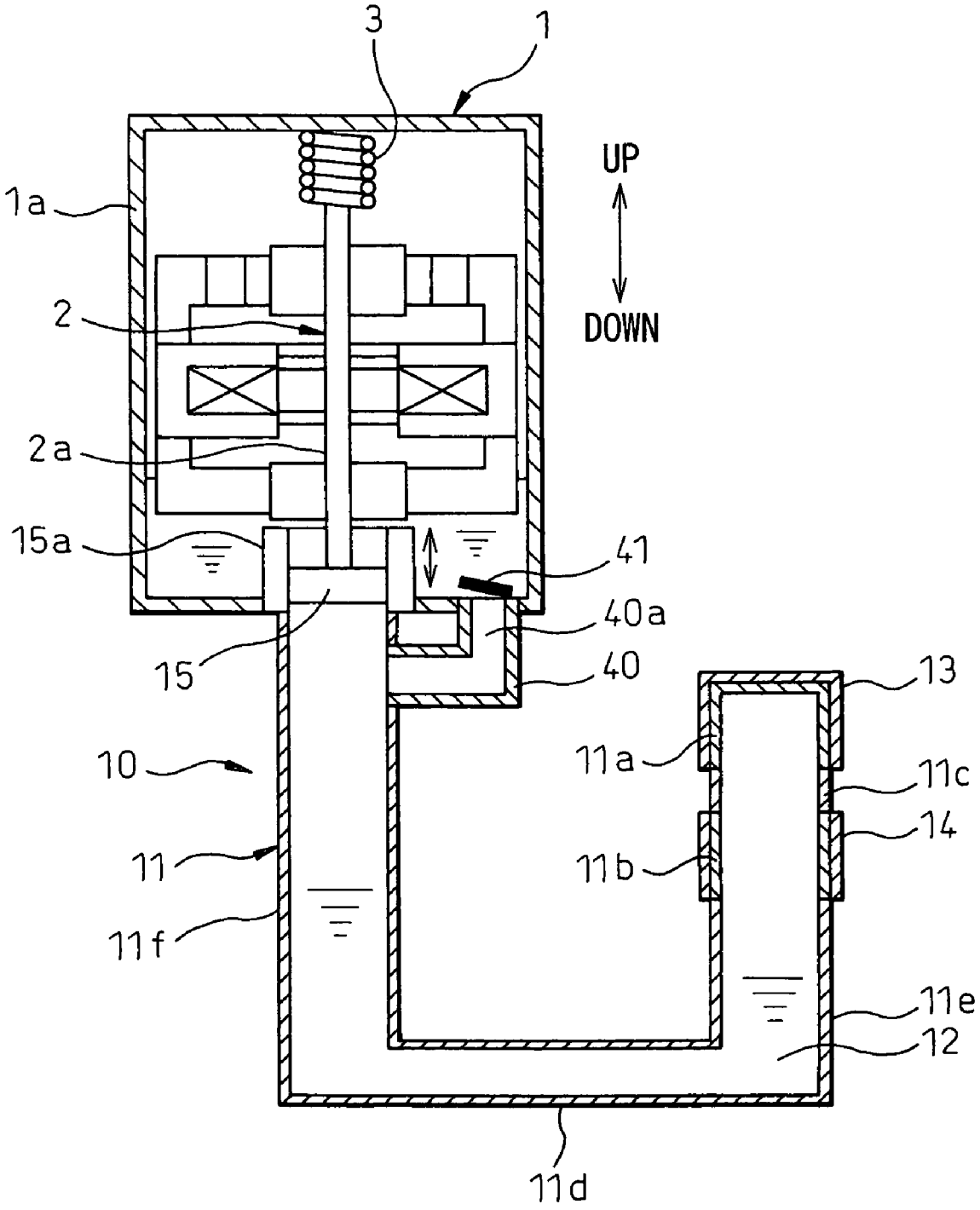
FIG. 4 is a view showing an outline of an external combustion engine of a third embodiment.

The third embodiment prevents the air in the generator 1 from passing through the very small clearance between the piston 15 and the cylinder 15*a* and flowing into the main container 11 by sealing the working fluid 12 inside the casing 1*a* of the generator 1. FIG. 4 is a view showing an outline of the external combustion engine 10 in the present embodiment.

The main container 11 and the casing 1*a* are communicated through a communicating passage 40*a* formed in the communicating member 40. In the present embodiment, as the shutoff valve 41 forming the shutting means for shutting the communicating passage 40*a*, a one-way valve is used. This one-way valve opens when the main container pressure becomes higher than the pressure in the casing 1*a*.

The pressure loss of the communicating passage 40*a* is set smaller than the saturated steam pressure at the heating portion temperature T1. In the present embodiment, the operating pressure of the shutoff valve 41 is also set smaller than the saturated steam pressure at the heating portion temperature T1.

In the present embodiment, after the external combustion engine 10 stops, the working fluid 12 in the casing 1*a* passes through the very small clearance between the piston 15 and the cylinder 15*a* and gradually flows into the main container 11 whereby the amount of liquid in the main container becomes excessive. However, at the time of restart of the external combustion engine 10, the shutoff valve 41 opens and the working fluid 12 in the main container 11 passes through the communicating member 40 and flows into the casing 1*a* corresponding to the auxiliary container. For this reason, the excess part of the amount of liquid in the main container (surplus amount of liquid for operation) can be quickly drained from the auxiliary container.

Furthermore, the pressure loss of the communicating passage 40*a* becomes smaller than the saturated steam pressure at the heating portion temperature T1, so at the time of startup, the excess part of the amount of liquid in the main container flows easier to the communicating passage 40*a* side than the heating portion 11*a* side. As a result, the flow of the liquid part of the working fluid 12 to the heating portion 11*a* can be suppressed. Therefore, the heat loss at the time of startup can be reduced.

As will be understood from FIG. 4, the present embodiment is configured to enable the flow length of the communicating passage 40*a* to be made shorter, so it is easy to make the pressure loss of the communicating passage 40*a* smaller than the saturated steam pressure at the heating portion temperature T1.

In the present embodiment, the piston mechanism 19 in the first embodiment etc. are not provided, so it is not possible to adjust the main container pressure. As a modification of the embodiment, the generator 1 may be provided with a piston mechanism 19 to adjust the main container pressure in the same way as the first embodiment. In this modification, the very small clearance between the piston 15 and the cylinder 15*a* exhibits the function as the venturi 17 in the first embodiment.

Other Embodiments

In the above embodiments, the example is shown of the main container 11 being formed in a single tubular shape as a whole, but the invention is not limited to this. In the main container 11, the portion at the heating portion 11*a* side may be formed by a plurality of branched pipes and the remaining part may be formed by a single merged pipe.

In the above embodiments, the example is shown of the present invention being applied to an external combustion engine 10 provided with a single main container 11, but the present invention may also be applied to an external combustion engine provided with a plurality of main containers 11 and coupling the plurality of main containers 11 by a single output part.

In the above embodiments, the case of application of the present invention to the drive source of a power generating system was explained, but the external combustion engine of the present invention may also be utilized as a drive source for something other than a power generating system.

While the invention has been described with reference to specific embodiments chosen for purpose of illustration, it should be apparent that numerous modifications could be made thereto by those skilled in the art without departing from the basic concept and scope of the invention.

The invention claimed is:

1. An external combustion engine provided with a pipe-shaped main container in which a working fluid is sealed flowable in a liquid state, a heating portion formed at a location at one end of said main container and heating the part of said working fluid in said main container to generate steam of said working fluid, a cooling portion formed at a location of said main container on the other end side thereof from said heating portion and cooling said steam to condense, an output part communicating with the other end of said main container and converting displacement of the liquid part of said working fluid generated due to the change in volume of said working fluid accompanying generation and condensation of said steam to mechanical energy for output, an auxiliary container communicating with said main container and having said working fluid sealed inside it, a venturi provided at a communicating part between said main container and said auxiliary container, a communicating member forming a communicating passage bypassing said venturi and communicating said main container and said auxiliary container, and a shutting means closing said communicating passage at the time of normal operation and opening said communicating passage at the time of startup, said output part having a piston displacing upon receiving pressure from the liquid part of said working fluid and a cylinder slidably holding said piston, said output part being driven as a startup means at the time of said startup, a displacement speed of said piston becoming the displacement speed of said piston at the time of normal operation or more when said output part is driven as said startup means, said communicating passage being formed so that when said output part is driven as said startup means and the displacement speed of said piston becomes the displacement speed of said piston at the time of normal operation or more, said pressure loss at the communicating passage becomes smaller than a saturated steam pressure at the temperature of said heating portion.

2. An external combustion engine as set forth in claim 1, wherein said output part has a casing communicating with said main container through said cylinder and having said working fluid sealed in it, said auxiliary container is formed by said casing, said venturi is formed by a very small clearance between said piston and said cylinder, and said communicating passage bypasses said cylinder and communicates said casing and said main container.

3. An external combustion engine provided with a pipe-shaped main container in which a working fluid is sealed flowable in a liquid state, a heating portion formed at a location at one end of said main container and heating the part of said working fluid in said main container to generate steam of said working fluid, a cooling portion formed at a location of said main container on the other end side thereof from said heating portion and cooling said steam to condense, an output part communicating with the other end of said main container and converting displacement of the liquid part of said working fluid generated due to the change in volume of said working fluid accompanying generation and condensation of said steam to mechanical energy for output, an auxiliary container communicating with said main container and having said working fluid sealed inside it, a venturi provided at a communicating part between said main container and said auxiliary container, a communicating passage bypassing said venturi and communicating said main container and said auxiliary container, and a shutting means closing said communicating passage at the time of normal operation and opening said communicating passage at the time of startup, said output part having a piston displacing upon receiving pressure from the liquid part of said working fluid and a cylinder slidably holding said piston, said output part being driven as a startup means at the time of said startup, when said output part is driven as said startup means, a displacement speed of said piston becoming slower than a displacement speed of said piston at the time of normal operation.

4. An external combustion engine as set forth in claim 3, wherein when said output part is driven as said startup means, the displacement speed of said piston is a speed whereby said pressure loss at the communicating passage becomes smaller than the saturated steam pressure at the temperature of said heating portion.

* * * * *